US005361975A

United States Patent [19]

Droste et al.

[11] Patent Number: 5,361,975

[45] Date of Patent: Nov. 8, 1994

[54] STRAWBERRY TRAY

[75] Inventors: Daniel L. Droste, Fremont; William F. Roozee, Covina, both of Calif.

[73] Assignee: International Paper Company, Purchase, N.Y.

[21] Appl. No.: 134,452

[22] Filed: Oct. 12, 1993

[51] Int. Cl.[5] ..... B65D 5/48

[52] U.S. Cl. ..... 229/120.34; 229/120.23; 229/120.35; 229/168; 229/178

[58] Field of Search ..... 229/120.23, 120.24, 229/120.33, 120.34, 120.35, 120.38, 167, 168, 178, 915, 919

[56] References Cited

U.S. PATENT DOCUMENTS

| | | | |
|---|---|---|---|
| 973,429 | 10/1910 | Hilliker | 229/120.34 |
| 1,910,480 | 5/1933 | Shoemaker | 229/120.34 |
| 2,105,057 | 1/1938 | Sharpe | 229/120.34 |
| 2,113,097 | 4/1938 | Schaefer | 229/120.34 |
| 2,155,450 | 4/1939 | Shoemaker | 229/120.33 |
| 2,457,291 | 12/1948 | Wenzel | 229/120.34 |
| 2,621,783 | 12/1952 | Buttery . | |
| 2,690,285 | 9/1954 | Main . | |
| 2,777,627 | 1/1957 | Crane . | |
| 2,875,939 | 3/1959 | Crane . | |
| 2,903,176 | 9/1959 | Crane . | |
| 2,910,220 | 10/1959 | Hamilton . | |
| 2,914,235 | 11/1959 | Jones . | |
| 2,961,143 | 11/1960 | Forrer | 229/120.33 |
| 2,990,995 | 7/1961 | Wessel . | |
| 2,998,909 | 9/1961 | Anderson, Jr. et al. | 229/915 |
| 3,036,753 | 5/1962 | Davis et al. | 229/915 |
| 3,048,318 | 8/1962 | Sabin . | |
| 3,055,572 | 9/1962 | Crane . | |
| 3,074,615 | 1/1963 | Johnson | 229/178 |
| 3,307,767 | 3/1967 | Humphrey et al. | 229/120.34 |
| 4,058,249 | 11/1977 | Buck . | |
| 4,529,088 | 7/1985 | Quong . | |

FOREIGN PATENT DOCUMENTS

| | | | |
|---|---|---|---|
| 187838 | 8/1991 | Japan | 229/120.34 |
| 899431 | 6/1962 | United Kingdom | 229/120.34 |

*Primary Examiner*—Gary E. Elkins

*Attorney, Agent, or Firm*—Michael J. Doyle; Paul R. Juhasz

[57] ABSTRACT

A shipping tray fashioned from a unitary blank of corrugated paperboard or the like and which is particularly adapted for the packaging of strawberries. The tray is provided with a separable longitudinal divider, also fashioned from a unitary blank of corrugated paperboard. The end structures of the tray are so formed that each tray end presents a slanting surface, with the divider panel also exhibiting a pair of opposed slanting surfaces. The slant of all of these surfaces fairly conforms to the slant of a conventional strawberry tray, to thereby minimize looseness of the strawberry trays in the tray of this invention. The divider panel, not being integral with the tray, need not be used. However, if used, the divider is easily inserted and taken out manually. Upstanding tabs at the tray ends are adapted to be received and fit into complementary recesses in the tray bottom, so as to thereby assist in aligning the trays when they are vertically stacked.

4 Claims, 3 Drawing Sheets

STRAWBERRY TRAY

BACKGROUND OF THE INVENTION

This invention relates to a shipping tray fashioned from corrugated paperboard or other stiff, foldable, and resilient sheet material and which displays particular utility for packaging of boxes of strawberries, the boxes having slanting sidewalls.

The packaging art is aware of trays for shipping a variety of items, such as fruit. Such trays are often formed of a unitary blank of corrugated paperboard or the like, and may also be provided with either an integral or a separate divider panel for separating the interior of the tray into two sections. Examples of such known constructions are shown in U.S. Pat. No. 3,048,318 issued to Sabin and U.S. Pat. No. 3,055,572 issued to Crane.

While apparently satisfactory for their intended uses, these two constructions, as well as other known constructions do not yield the advantages of the present invention.

SUMMARY OF THE INVENTION

According to the practice of this invention a collapsible tray is fashioned from a unitary blank of corrugated paperboard or the like, the blank being provided with suitable fold or score lines and tabs and tab recesses to provide a tray when erected. Further, a separate divider panel, longitudinally dividing the tray interior into two sections, is fashioned from a second unitary blank of corrugated board and may be manually placed into the tray after the tray has been fully erected, with the divider having ends which fit into complimentary recesses on opposite end portions of the tray interior. The divider panel, as well as the interior opposite ends of the tray, are both slanted so as to fairly conform to the slant of conventional strawberry boxes.

DETAILED DESCRIPTION OF THE INVENTION

Figure 1:
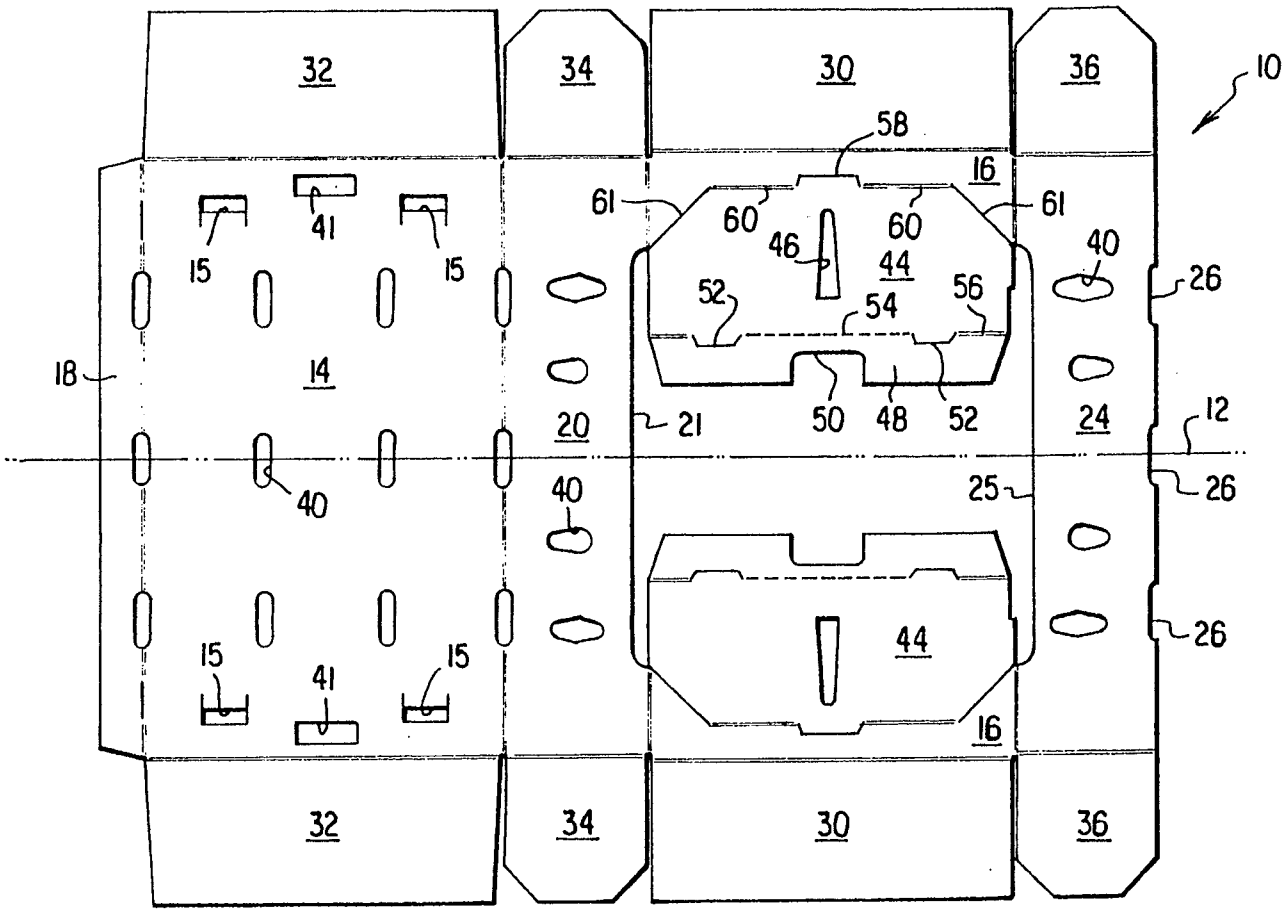
FIG. 1 is a plan view of a unitary blank of corrugated paperboard or the like for forming the tray of this invention.

Referring now to FIG. 1 of the drawings, a unitary blank 10, typically fashioned of corrugated paperboard, is provided with a plurality of horizontally and vertically extending score lines, the terms vertically and horizontally being used in their relation to horizontally extending longitudinal axis 12 of the blank. A bottom forming panel is designated as 14 and is provided at its upper and lower portions respectively with a pair of spaced apertures 15. Each of a pair of upper surface panels 16 is foldably secured on its left edge to a side wall panel 20 by means of the indicated vertical fold lines. Side wall 20 is provided at its right free edge portion with a cut out or recess 21 and is foldably secured to panel 14 at its left edge. The right hand portion of upper surface panels 16 are each foldably secured to a second side wall panel 24, the latter having a recess 25 along its left edge, complimentary to recess 21 of panel 20. Side wall panel 24 is provided along its right free edge with a plurality of recesses 26, one of which is bisected by horizontal axis 12 of the blank.

Left hand edge of bottom forming panel 14 is provided with a glue flap 18, flap 18 and bottom forming panel 14 being joined through the indicated vertically extending fold line. Each upper and lower edge of bottom panel 14 is provided with respective first end wall forming panels 32, foldably secured through the indicated horizontally extending fold lines. Additional and second end wall panels 34 are provided at respective upper and lower ends of panel 20 through the indicated horizontally extending fold lines, while additional and third end wall forming panels 30 are provided along respective edges of upper and lower panels 16. Similarly, additional end wall forming panels 36 are provided at respective upper and lower ends of side wall panel 24, joined thereto by respective horizontal fold or score lines.

Each upper panel 16 is provided with a pair of spaced fold lines 60, separated by a tab forming cut line 58, and having cut lines 61 separating a respective end abutment panel 44 from each panel 16. Thus, each end abutment panel 44 is secured to its respective panel 16 only by a pair of spaced fold lines 60, with the remainder of their adjacent edges being separated by cut lines 58 and 61. A triangular opening 46 is provided centrally of each end abutment panel 44, with a lower portion of each panel 44 (referring to the uppermost panel 44 shown at FIG. 1) provided with a pair of spaced cut lines 52 for the purpose of forming tabs, a pair of outermost fold lines 56 and a single central perforated line 54 which will serve as a fold line. The lower portion of each panel 44 (again referring to the uppermost panel 44 of FIG. 1) is provided with a section 48, the latter centrally provided with a recess 50. Each panel 48 is secured to its respective panel 44 by folds 54 and 56. Vent openings 40 are provided in panels 14, 20, and 24. It will be seen from FIG. 1 that upper panel 44 is mirror symmetrical with respect to lower panel 44 about axis 12.

Figure 2:
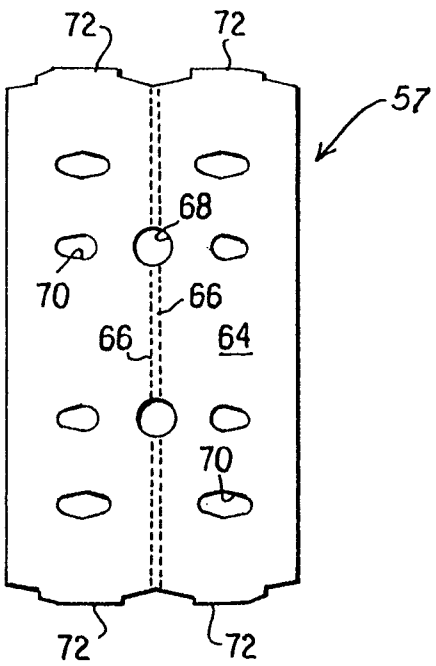
FIG. 2 is a plan view of a unitary blank of corrugated paperboard for forming the divider for the tray of this invention.

Referring now to FIG. 2 of the drawings, a unitary blank 57 for forming a divider panel is illustrated, the blank typically fashioned from corrugated paperboard. A pair of slightly spaced central fold lines 66 run from the upper to lower edges of blank 58, to thereby define two blank panels 64. A plurality of vent openings 70 is provided at each panel 64, with each panel 64 having at its upper and lower edges tabs 72 for insertion into respective openings 46 of respective panels 44.

Figure 3:
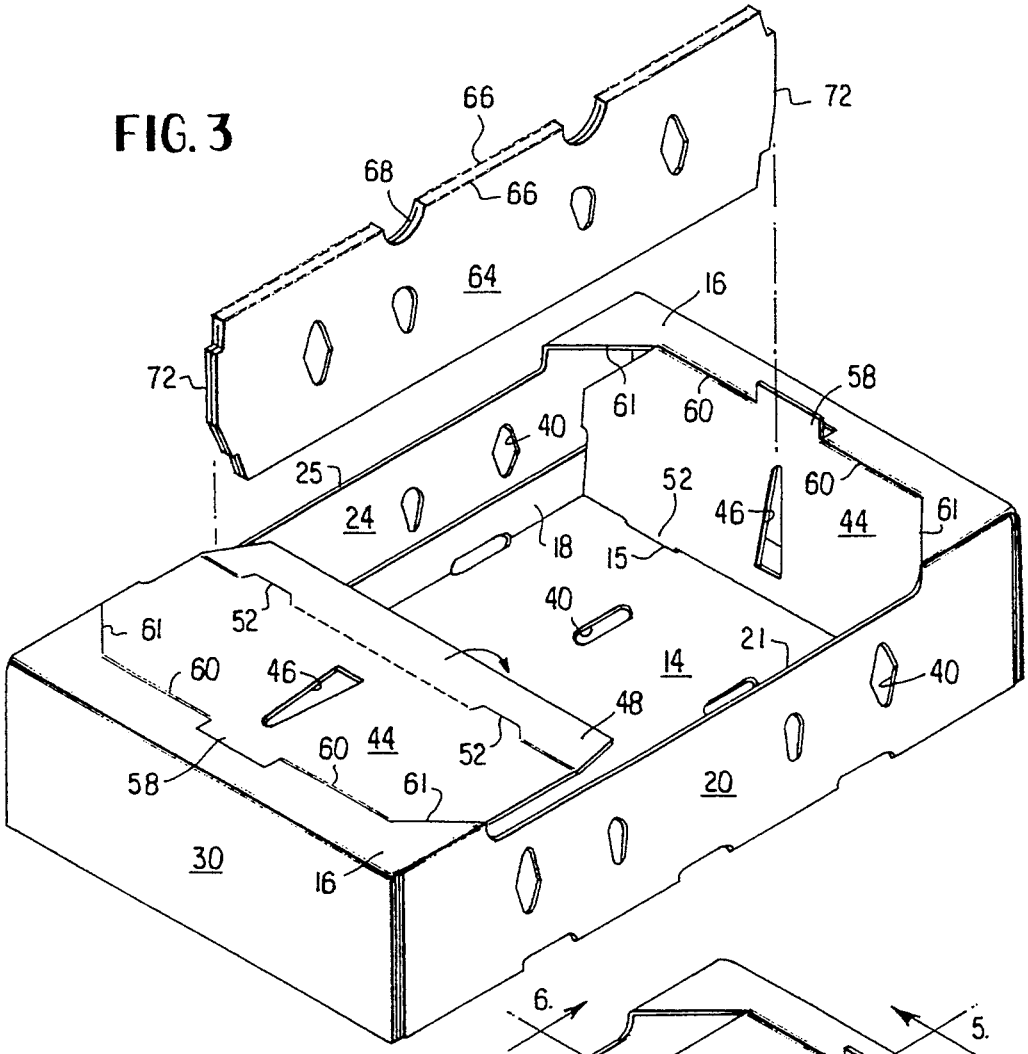
FIG. 3 is a perspective view illustrating an intermediate stage in the formation of the tray of this invention from the blanks of FIGS. 1 and 2.
Figure 4:
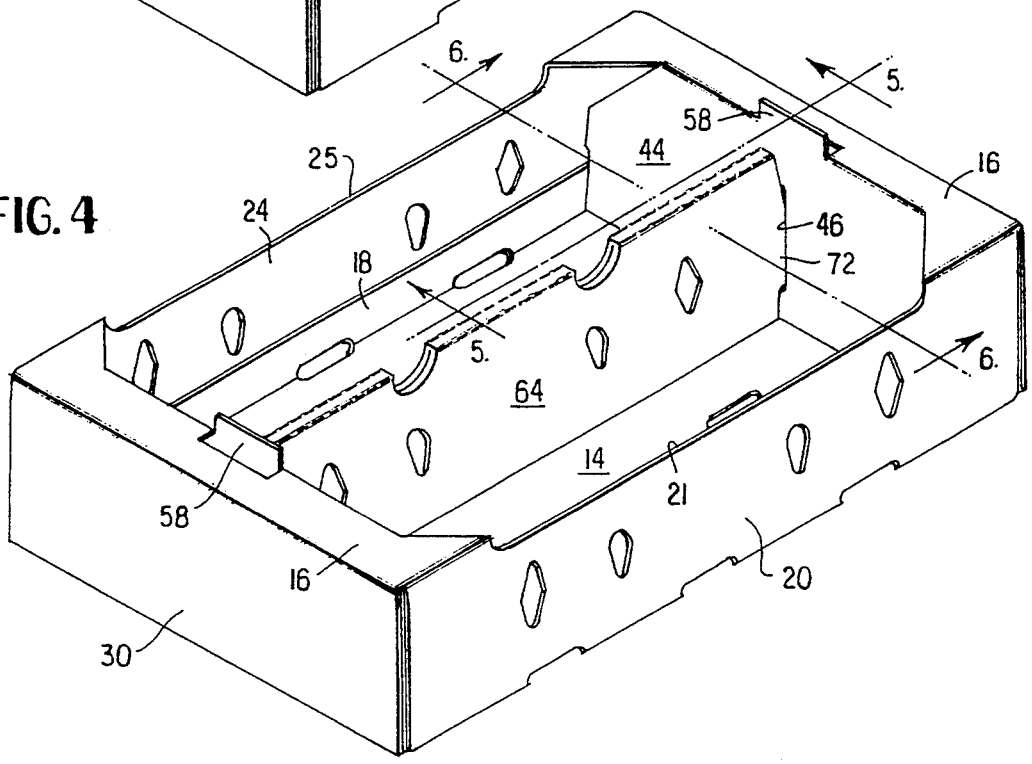
FIG. 4 is a view similar to FIG. 3 and shows the completed strawberry tray of this invention.

Referring now to FIG. 3 of the drawings, an intermediate stage in the formation of the tray of this invention is illustrated. The blank of FIG. 1 has been folded and glued to form a tray having a bottom 14, side walls 20 and 24, and composite end wall structures. Tabs 52 (defined by cut lines 52) of each panel 44 are received in complementary bottom panel openings 15. Flap 18 is glued to the lower interior portion of side wall 24. FIG. 4 shows the final stage in the formation of the tray, with the panel 44 nearest the reader of FIG. 3 having been folded down and its tabs 52 also inserted into respective recesses 15 in bottom panel 14. In FIG. 4, the ends of divider 58 have been inserted into respective recesses 46, so that respective pairs of tabs 72 at each divider end fit into a respective recess 46.

Figure 5:
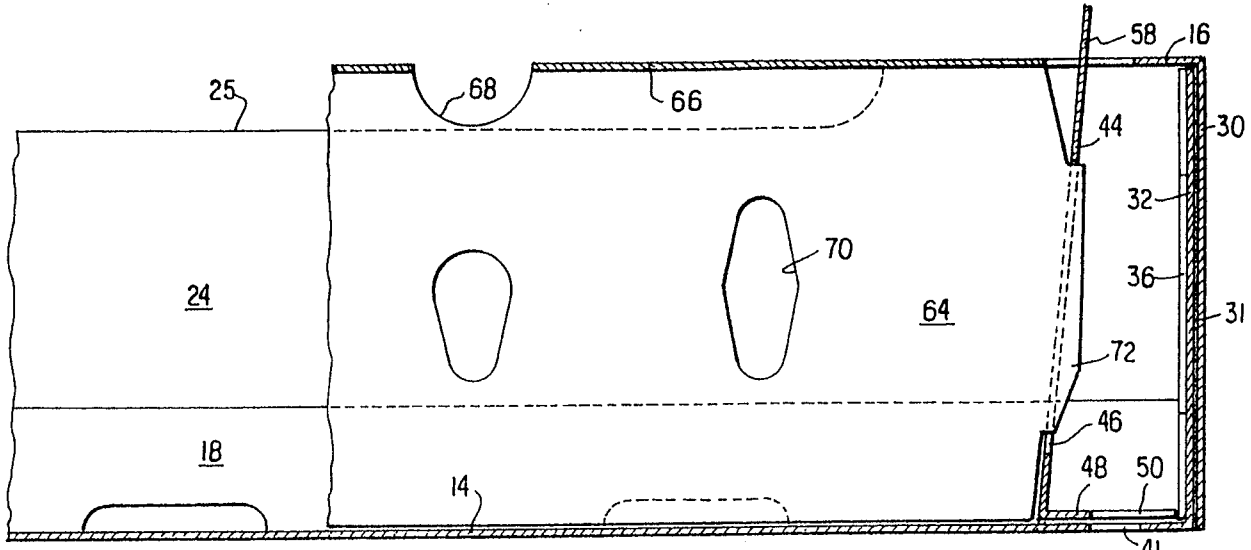
FIG. 5 is a view taken along section 5—5 of FIG. 4.
Figure 6:
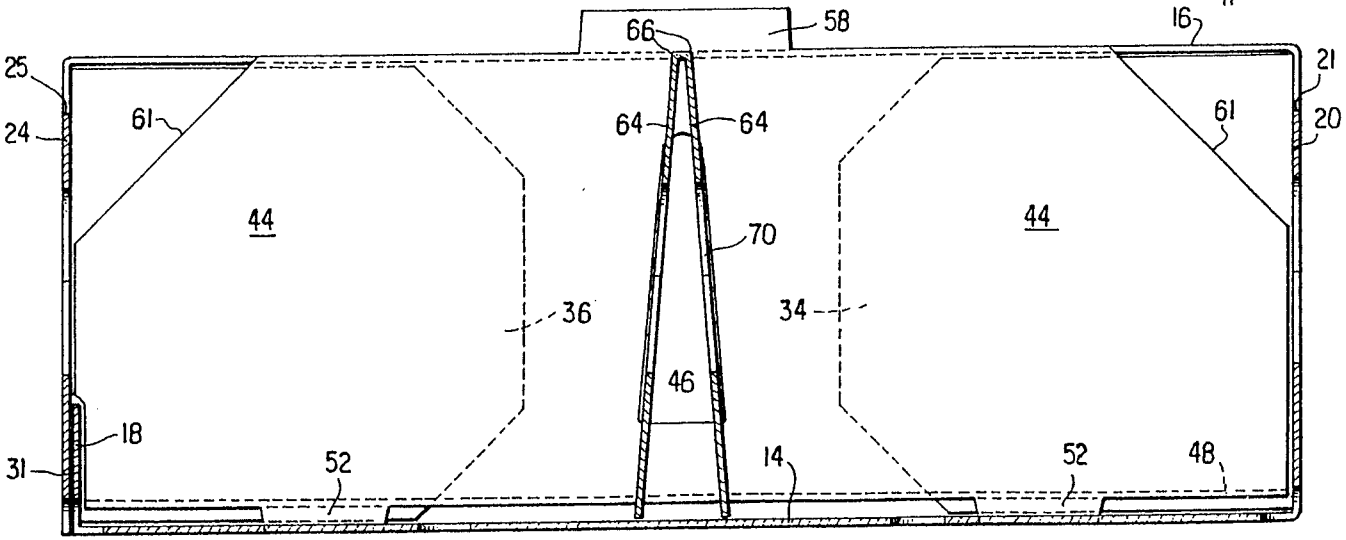
FIG. 6 is a view taken along section 6—6 of FIG. 4.

FIGS. 5 and 6 further illustrate the tray construction, with FIG. 5 showing that outermost end panel 30 is glued over innermost end panel 32 (at each end) by means of an adhesive denoted at FIG. 5 by 31. It is seen that each end panel 44 slants, so as to approximate the slant of a conventional strawberry tray. It will be further observed that the longitudinally extending divider 58 has its two panels 64 also tilting, so as to approximate the tilt of a conventional strawberry tray. Panels 36 and 34 are glued to respective ends of innermost end panels 32, as seen both at FIGS. 5 and 6. Thus, in FIG. 6, panel 44 is in front of panels 34 and 36 and hence are not seen. The mode of inserting the longitudinally extending divider panel is, typically, manually, with the construction being such that there is a fairly loose fit of tabs 72 into respective openings 46. The natural resiliency of the corrugated paperboard from which the divider is formed maintains the triangular cross section of the divider, shown at FIG. 6, with panels 64 being resiliently urged apart.

FIG. 5 illustrates an upstanding tab at each tray end formed from cuts 58, also designated as 58. Tabs 58 are each adapted to engage a respective recess 41 in the bottom panel whenever two or more of the trays are vertically stacked, so as to assure vertical alignment of the trays.

We claim:

1. A tray formed from a unitary blank of stiff, foldable and resilient sheet material, the tray having an interior, the tray having a horizontal bottom wall, two vertical side walls, two vertical plural ply end walls, and end wall abutment panels each spaced from a respective one of said plural ply end walls, each of said end wall abutment panels provided with an opening having two edges, an upper wall at each end of said tray to thereby define two longitudinally spaced upper walls, and a divider extending from one said end abutment panel to the other end wall abutment panel and dividing said tray interior into two portions, said divider including two divider panels integrally joined together along common edges, each of said divider panels having ends, said divider fashioned of stiff, foldable, and resilient sheet material, said divider panels having tongues at their ends which fit into respective said openings of said end abutment panels, the resiliency of said divider urging said divider tongues against respective said edges of said openings in said end wall abutment panels to produce slanted divider sides.

2. The tray of claim 1 wherein each of said end wall abutment panels carries at least one tab at a lower edge thereof, each said tab fitting into a respective recess in said bottom wall, and wherein said end abutment panels each carry an upwardly projecting alignment tab.

3. The tray of claim 1 wherein said end wall abutment panels are slanted in a downwardly converging manner relative to each other, and wherein said edges of each of each said openings of said end wall abutment panels are downwardly diverging.

4. A unitary blank of corrugated paperboard, said blank having a central horizontal axis and being generally rectangular, the blank including a bottom forming panel, a first side wall forming panel, a pair of upper wall forming panels, and a second side wall forming panel, each said upper wall forming panel foldably connected to an end wall abutment panel having a foldable flap remote from a foldable connection between said end wall abutment panel and said upper wall forming panel, each said end wall abutment panel having an opening therein, wherein each said end wall abutment panel opening is generally triangular, and wherein each said generally triangular opening has a longitudinal axis generally at right angles to said horizontal axis of the blank.

* * * * *